United States Patent [19]

McCole

[11] 4,312,939

[45] Jan. 26, 1982

[54] PHOTOGRAPHIC PRODUCT AND PROCESS OF MAKING THE SAME

[75] Inventor: Thomas P. McCole, South Natic, Mass.

[73] Assignee: Polaroid Corporation, Cambridge, Mass.

[21] Appl. No.: 141,367

[22] Filed: Apr. 18, 1980

[51] Int. Cl.[3] ..... G03C 1/40; G03C 1/48

[52] U.S. Cl. ..... 430/497; 430/207; 430/496; 430/498

[58] Field of Search ..... 430/207, 208, 497, 498, 430/499, 496

[56] References Cited

U.S. PATENT DOCUMENTS

| | | | |
|---|---|---|---|
| 3,607,285 | 9/1971 | Chen | 430/209 |
| 3,752,723 | 8/1973 | Bruneau | 430/207 |
| 3,761,268 | 9/1973 | Land et al. | 430/207 |
| 4,040,830 | 8/1977 | Rogers | 430/207 |
| 4,042,395 | 8/1977 | Tone et al. | 430/209 |
| 4,092,167 | 5/1978 | Bushey et al. | 430/207 |

*Primary Examiner*—Richard L. Schilling
*Attorney, Agent, or Firm*—John W. Ericson

[57] ABSTRACT

A photographic film unit comprising a photosensitive sheet, in the form of an inert support coated on one side with one or more photosensitive layers, fixed to a second sheet having at least one inert side by a pair of rails adhered to an inert side of one of the sheets and to portions of the other sheet, in which the ends of one of the sheets extend beyond the other to provide supports at opposite ends for a pod carrying processing composition and for a fluid trap, and a mask and binder member securing the sheets together at their edges. A method of making the film unit in which the first and second sheets are brought together and adhered to each other by binder strips placed over them at prescribed intervals. The sheets so fixed together are then adhered to a binder web at one end thereof, and pieces of them are cut off and carried with the binder web through stations at which the additional elements of the film unit are installed and the assembly operations completed.

13 Claims, 7 Drawing Figures

PHOTOGRAPHIC PRODUCT AND PROCESS OF MAKING THE SAME

This invention relates to photography, and particularly to a novel photographic film unit and method of making the same.

Numerous photographic image producing processes have been proposed and developed in which a latent image formed on a photosensitive sheet is developed and converted to a desired visible image or images by passing a fluid processing composition between the photosensitive sheet and a confronting sheet, whereupon at least one image becomes visible through or upon one of the sheets after conversion of the latent image to the desired visible image by diffusion transfer processes. Typical products and processes for use in the preparation of finished photographic images by diffusion transfer processes are described, for example, in U.S. Pat. No. 4,040,830, issued on Aug. 9, 1977 to Howard G. Rogers for Photographic Products Comprising Embossed Supports, and assigned to the assignee of this invention.

Usually, in film units proposed for practicing the processes such as those described above, one of the two sheets between which the processing fluid is to be spread is made longer than the other at leading and trailing edges, such that a rupturable pod containing processing composition can be supported at one end, and a trap structure for receiving excess processing fluid can be supported at the other. In such constructions, means are provided at the sides of the sheets, which are generally of the same lateral dimensions, to prevent the escape of processing composition from the sides of the confronting sheets during the spreading and processing operations. Various constructions have been proposed for carrying out this function. For example, in U.S. Pat. No. 3,752,723, issued on Aug. 14, 1973 to Louis O. Bruneau for Method of Manufacturing Self-Developing Photographic Film Units and assigned to the assignee of this invention, a method of assembly is described in which the first and second sheets are temporarily laminated together by supplying a laminating liquid between them as they are passed between a pair of nip rolls under pressure. When the pod of processing composition is ruptured by pressure applying rollers during the processing of a film unit made in this manner, the lamination is interrupted by the escaping fluid under pressure so that the processing fluid can pass between the sheets and perform its desired function. In this construction, a mask having portions wrapped around the sides of the sheets confines the processing composition. As an alternative to this construction, U.S. Pat. No. 3,752,723 proposes that the two sheets be heat sealed together in regions near their margins to hold them together during film assembly. Still another approach is shown and described in U.S. Pat. No. 4,042,395. In the latter patent, a film unit construction is described in which the two sheets are permanently joined together at the edges by means of rails adhered between the sheets. Such rails also function to provide a desired minimum space betweem the sheets to control the gap between the sheets and thereby establish the minimum thickness of the layer of processing composition which is spread between them when the film unit is processed.

The function of providing a minimum spacing between the sheets near the edges thereof that is performed by the rails described in the above cited U.S. Pat. No. 4,042,395 may be useful in preventing effects that might otherwise occur if the superposed sheets where simply clamped together at the edges, particularly within the image area, by processing rollers or other pressure applying means employed to compress and rupture the pod and spread the processing composition between the sheets. However, it is undesirable to require an adhesive bond between the confronting faces of the sheets involving heat activation, particularly where the photosensitive one of the sheets has its photosensitive side confronting the other, as is the usual arrangement. Among the problems are both that the photosensitive sheet may be sensitive to the temperature of adhesive activation in a way that will deleteriously effect its sensitometry, and that the usual photographic coatings have poor mechanical and adhesive properties. As an example, if the edges or corners of one sheet are to be staked to the other by heat and pressure, it has been found necessary to use sufficient heat and pressure to displace the photographic layers to allow the underlying support to be fused to the other sheet. This may produce undesirable sensitometric effects, and mechanical problems such as buckling or wrinkling induced by thermal stresses. Even where an adhesive not requiring activation by heat and/or pressure is employed, the initial seal that may be obtainable between the confronting sheets can be deleteriously affected when the sheets are wet by processing composition during processing of the image. Joining the sheets by lamination together with laminating liquid, as proposed in the above cited U.S. Pat. No. 3,752,723, does not involve these particular problems because only a temporary lamination is desired and a weak bond is sufficient, in addition to which the laminating liquid can be applied at a temperature at which the photosensitive sheet is stable.

Film unit constructions in which a gap between the sheets during the spread of processing composition is attained by spacing means external to the sheets are disclosed in U.S. Pat. No. 3,761,268, issued on Sept. 25, 1973 to Edwin H. Land and Richard J. Chen for Self-Developing Film Unit Assemblange, and assigned to the assignee of this invention. As there described, it may be desirable to provide for a tapering of these external spacing means, which do not require any particular adhesion between the photosensitive sheet and the superposed sheet, from the leading end to the trailing end of the film unit. U.S. Pat. No. 3,761,268 describes such tapering spacing means as being provided in the form of a masking element of tapering thickness, which also performs the function of defining the final image area in the processed image. Another construction for this purpose, also involving an external mask as part of the gap control structure, is shown and described in U.S. patent application Ser. No. 811,714, filed on June 30, 1977 by John E. Campbell and Charles B. Thompson, now abandoned, for Photographic Product and assigned to the assignee of this invention. In that application, the desired tapering controlled spacing between the sheets is obtained by a tapered rail inserted between the mask and the sheets sandwiched therebetween.

Among the objects of this invention are to simplify the construction of photographic film units of the type comprising superposed sheets between which a layer of processing composition is spread after exposure of a latent image, and to facilitate the attainment of precise gap control between the sheets during processing, without requiring either an adhesive bond between the photosensitive side of a photosensitive one of the sheets and the other, or a temporary lamination of the confronting faces of the sheets together.

Briefly, the above and other objects of the invention are attained by the practice of a novel process in which a photosensitive sheet and a second sheet are joined temporarily or permanently together by a series of rail elements adhered along the edges to an insensitive side of one of the sheets and to limited regions of the confronting side of the other sheet such that the rail elements lie along the lateral edges of regions within which are the image areas of a series of film units. The sheets so joined are then laminated at an end thereof to a binder web which is formed with apertures and extensions adapted to provide a mask around the finished film unit and to enclose rupturable pods and trap elements to be added thereto.

When the first and second sheets are adhered at one end to the binder web, the sheets are next cut off at a location dividing the next following rail element in two and separating a film unit portion from the sheets. The film unit portion transferred to the binder web in this manner is next fully laminated to the binder web, pods and traps are added, and the film unit is completed in a conventional manner. Film units produced by this process are generally characterized by a photosensitive sheet laminated to another sheet by a rail structure comprising a pair of binder rail elements extending across an insensitive side of a first of the sheets along a pair of edges, and coming down into adhesive contact with the other sheet along ends extending beyond the ends of the first sheet. In the finished structure, in accordance with a preferred embodiment of the invention, the pod of processing fluid overlies the extending binder rail at first ends thereof, and a trap element overlies the other ends of the binder rail elements to provide increased trap pocket depth. The binder rail elements may be provided with a tapering thickness from leading edge to trailing edge of the completed film units, or may be of uniform cross-section, as desired for a particular application.

The structure of film units in accordance with the invention, and the process of making the same, will best be understood in the light of the following detailed description, together with the accompanying illustrative drawings.

Figure 1:
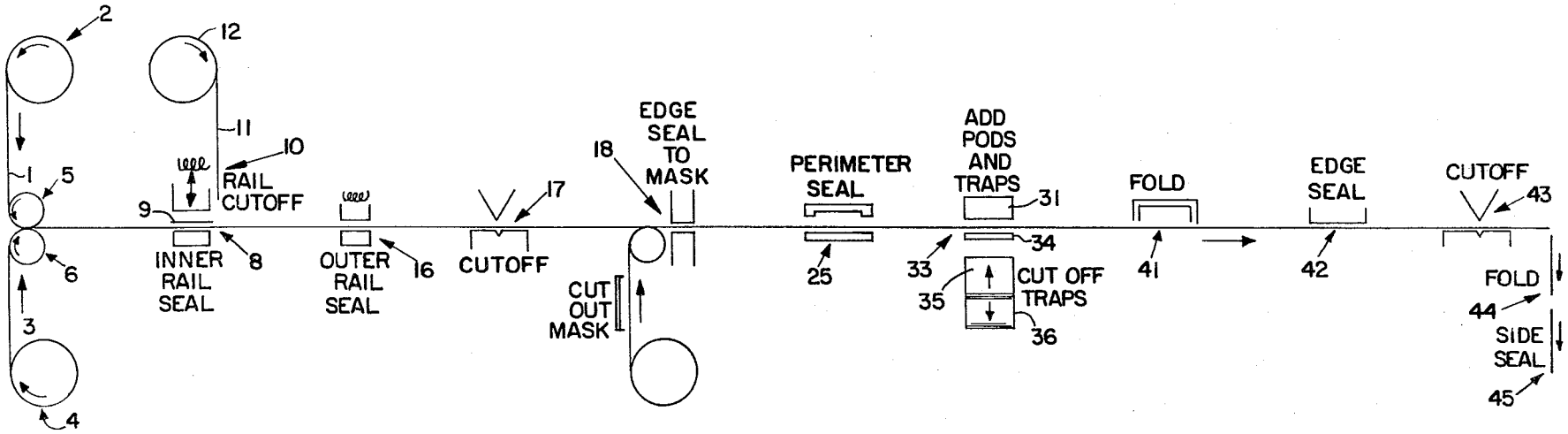
FIG. 1 is a schematic flow diagram of a process of making film units in accordance with the invention.
Figures 2, 7:
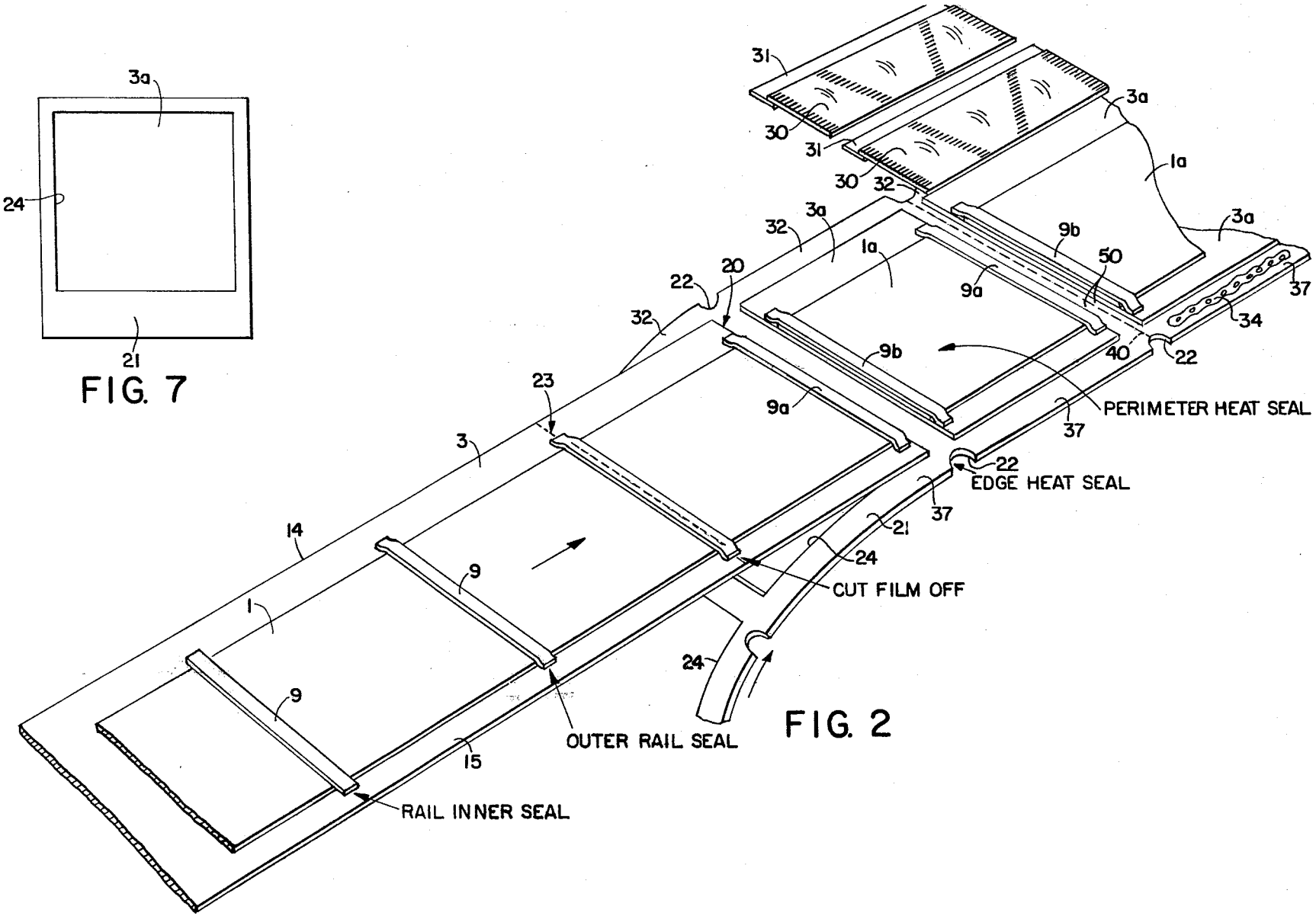
FIG. 2 is a fragmentary schematic perspective sketch, with parts broken away, illustrating a portion of the process of FIG. 1 in more detail.
FIG. 7 is a plan view of the film unit of FIG. 3 as seen from the other side and on a reduced scale.

FIGS. 1 and 2 illustrate a process of assembling photographic film units that in respects consistent with the description which follows may be carried out in the manner described in more detail in U.S. Pat. No. 3,752,723, which is incorporated herein by reference.

Referring to FIG. 1, a first sheet 1 taken from a supply roll 2 is first joined to a second sheet 3 taken from a supply roll 4, as by bringing the sheets 1 and 3 together into the nip of a pair of driven rolls 5 and 6. Suitable guide and tensioning means may be arranged in a conventional manner, not shown, to bring the sheets together into registry as shown in FIG. 2 with the sheet 1 overlying the sheet 3 and placed intermediate the edges of the sheet 3.

At least one of the sheets 1 and 3 comprises photosensitive material, and may typically be formed by coating one or more photosensitive layers on an opaque or transparent support. The other sheet may comprise a single material serving simply to confine processing fluid as it is spread over the photosensitive sheet, or may be coated with materials serving to form an image receiving layer or perform other photographic functions, in cooperation with the materials of the sheet 1 and with a layer of processing composition spread between the sheets, to transform a latent photosensitive image on one of the sheets into a positive and/or negative image in black and white, monochrome or polychrome that is suitable for viewing by transmitted or reflected light, or for further processing. As concrete examples, one of the sheets 1 and 3 may be a photosensitive structure of the type described in U.S. Pat. No. 4,040,830, and the other sheet an image receiving structure as described in that patent; alternatively, both the image receiving and photosensitive elements may be in both sheets and the other sheet may serve to carry on said layer covered by a timing layer, as also described, for example, in U.S. Pat. No. 4,040,830. Other suitable configurations are shown and described in U.S. Pat. No. 3,647,437, issued on Mar. 7, 1972 to Edwin H. Land for Photographic Products, Processes and Compositions and assigned to the assignee of this invention. In general, whatever the particular structures and functions of the sheets 1 and 3, each will generally have at least one surface of transparent or opaque material which is inert in the sense that it does not play a functional role in the photocemical diffusion transfer image forming process, either through chemical reaction or by diffusion transfer rate control. The photosensitive sheet will generally comprise a dimensionally stable inert support on one side of which the photosensitive or photographically effective layers are coated. One or more surfaces of either sheet may, of course, be overcoated with materials selected for their effectiveness in decoration or to perform an optical function in the reflection of light from or transmission of light through the sheet. Where one of the sheets 1 and 3 merely serves as a spreader sheet, it may, if desired, be a homogeneous composition made of a suitable material such as a polyester or the like. At least the photosensitive one of the sheets 1 and 3 has its photosensitive side confronting the other. Where the other sheet is also coated with layers that take part in a diffusion transfer photographic process, the side on which these layers are coated should face the first sheet. In a particular and presently preferred embodiment of the invention, the sheet 1 is a photosensitive sheet and sheet 3 is a transparent image receiving sheet.

Referring to FIG. 2, in a particular embodiment to be described, the sheet 1 may comprise an opaque support coated with a series of photosensitive layers, dye developer layers, and interlayers in the manner shown and described in detail in U.S. Pat. No. 4,040,830, and particularly with regard to the photosensitive element described in connection with FIG. 1 of that patent. The photosensitive side of the sheet 1 would be that confronting the sheet 3. With this form of photosensitive sheet 1, the sheet 3 may comprise an image receiving element such as that described in connection with FIG. 1 of U.S. Pat. No. 4,040,830, with or without the non-planar surface formed on the transparent support comprising the outer layer of the image receiving element. In this embodiment, the side of the sheet 3 on which the transparent dimensionally stable support is located would face away from the sheet 1, and the side of the sheet 3 on which the image receiving layer is coated would confront the photosensitive side of the sheet 1.

At the point where the sheets 1 and 3 are joined by the rolls 5 and 6 in FIG. 1, the process of assembling film units in accordance with the invention differs from that shown and described in the above-cited U.S. Pat. No. 3,752,723, in that in the process described in U.S. Pat. No. 3,752,723 the sheet 1 would be laminated to the sheet 3 by means of a laminating fluid introduced between the rolls 5 and 6, or alternatively, the sheets would be temporarily laminated by heat sealing jaws to connect regions of the sheet 1 mechanically to the sheet 3. In accordance with this invention, however, the sheets are not laminated or connected together by a face-to-face adhesive bond, but are simply held together in registry until joined together in the manner to be described. An advantage of the process of the invention over the process in which face to face lamination is employed is the elimination of the path length required between the laminating station and the next operation, needed to allow the laminate to be dried, during which the sheets must be carried over rollers that may induce delamination.

During the process of assembly to be described, the sheets 1 and 3 are advanced together, for a predetermined distance increment, stopped while various operations are performed at a series of stations, and then advanced again by the same increment, and so on. This increment is selected to be equal to the width of a subassembly comprising portions of the sheets 1 and 3 in the finished film unit.

As each such incremental advance step is carried out, a new region of the superimposed sheets 1 and 3 is advanced to a station schematically indicated at 8 at which an extended rail element 9 is heat sealed to the insensitive support side of the photosensitive sheet 1. Individual extended rail elements 9 may be cut off as needed, as indicated at 10, from a suitable supply such as a web of rail material 11 taken from a supply roll 12.

Referring to FIG. 2, the individual rail elements 9 may be of uniform cross-section, or if desired they may be tapered from a leading edge 14 of the sheet 3 toward a trailing edge 15 of the sheet 3. The rail elements 9 may be made of paper, such as a kraft paper 1 to 1½ mils in thickness, coated with a suitable heat activated adhesive on the side confronting the sheet materials 1 and 3.

Following the adhesion of a rail element 9 to the outer surface of the sheet 1, the sheets are next advanced to a station indicated at 16 in FIG. 1 at which the ends of each rail element are heat sealed to the confronting face of the sheet 3. It should be pointed out in this regard that while FIG. 2 suggests that the outer rail seal is made immediately adjacent the inner rail seal at station 8, this is primarily for conciseness in the drawings; more than one film unit increment of advance may occur before this sealing operation is carried out for convenience in arranging the sealing apparatus. In addition, if desired, both the outer and inner rail seals may be completed at the same station by use of appropriately shaped heated platens. It will be noted that while the ends of the rail elements 9 are sealed to the sensitive side of the sheet 3, these points of attachment are beyond the bounds of the sheet 1 that define the maximum image producing area.

Following the completion of the outer rail seal at the station 16, the sheets 1 and 3 are advanced through a station 17 to a station 18 at which the leading edge 20 of the sheet 3 is heat sealed to a mask 21 of opaque liquid impermeable material coated on the surface confronting the sheet 3 with a suitable heat activatable adhesive. A presently preferred material for this purpose is described in more detail in the above-cited U.S. application Ser. No. 811,714. Briefly, this material comprises a sheet of biaxilly oriented polyethylene terepthalate metalized on one surface by vapor deposition with aluminum to enhance the hiding power of the sheet. Onto the metalized surface of the polyester is coated a layer of primer, a layer of white pigment in a binder, and a slip coat. On the polyester side of the aluminized sheet, the polyester is coated with a primer for better adhesion to a heat seal adhesive layer, the latter forming the external surface confronting the sheet 3 in FIG. 2. Specific suitable materials are described in detail in the above-cited application Ser. No. 811,714, which is hereby incorporated herein by reference.

In one practical embodiment, the polyester component of the mask 21 may be 0.92 mils in thickness and the overall thickness of the mask may be 1.65 mils in thickness.

In the next operation, after the edge heat seal has been formed at station 18 in FIG. 1, the sheets 1 and 3, and one of the binder strips 9, is cut as indicated by the dotted line 23 in FIG. 2 to divide the binder strip 9 into two strips **9*a* and 9*b* each comprising a binder rail element for a film unit. Next, the web 21, carrying the now attached piece 3*a* of the sheet 3 on which there is mounted the portion 1*a* of the sheet 1 attached thereto by the binder rails 9*a* and 9*b*, is advanced a distance equal to the spacing between adjacent notches 22 cut in the edges of the mask 21, carrying the pieces 1*a* and 3*a* of the sheet material beyond the leading edge 20 of the sheets 1 and 3 by a distance sufficient to allow for two side masking areas of the sheet 21 that will later be folded over the rails 9*a* and 9*b***.

In the edge heat sealing operation previously described, the leading edge 20 of the sheet **3*a* is sealed to the sheet 21 in a region bordering an aperture 24 cut out to provide the desired image viewing area in the finished film unit. At a subsequent station indicated at 25 in FIG. 1, a perimeter seal is made joining all of the borders of each sheet 3*a* to portions of the mask 21 surrounding the aperture 24, so that all of the four borders of the sheet 3*a* are adhered to the mask 21**.

Referring now to FIG. 2, in an auxiliary operation described in more detail in the above-cited U.S. Pat. No. 3,752,723, rupturable pods 30 of processing composition have sealing strips 31 attached to one edge thereof. Sealing strips 31 may be of any suitable liquid impermeable material; for example, a laminate of polyethylene terepthalate with paper on the outer sides from 1–3 mils thickness, coated on the side facing the pods 30 in FIG. 2 with suitable heat activated thermoplastic adhesive composition. The pods are placed on tabs 32 formed at one edge of the mask 21, and sealed to the tabs 32 by heat and pressure.

Referring to FIG. 1, trap elements 34 may be made by cutting off strips from a perforated web 35 supplied from a supply roll 36. As suggested in FIG. 2, the trap elements 34 are heat sealed to flaps 37 comprising extensions of the mask 21 that protrude beyond the ends of the image receiving sheets 3*a*.

Figure 3:
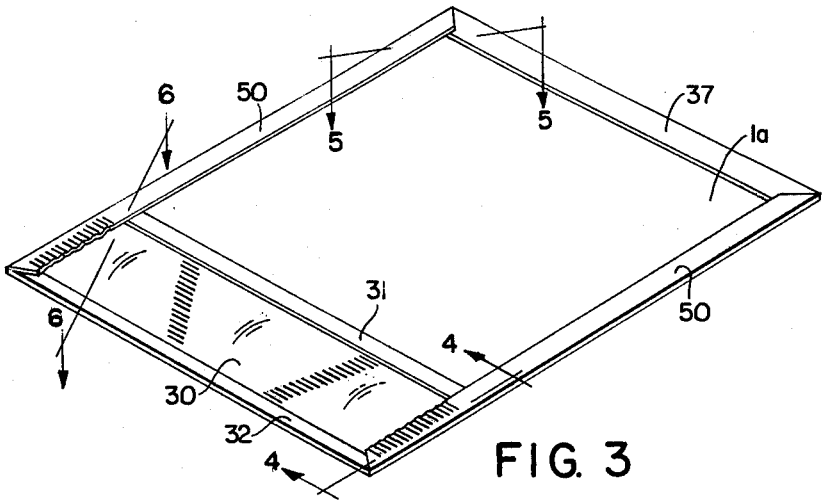
FIG. 3 is a schematic perspective sketch of a completed film unit in accordance with the invention.

Referring again to FIG. 1, operations beyond the stations 33 at which the pods and traps are added comprise folding the flags 32 and 37 carrying the pods 30 and traps 34 up over the edges of each sheet 3*a* at a station indicated at 41 in FIG. 1, next sealing the sealing strip to the border of the sheet 1*a* at one end, and the edges of the flap 37 over the ends of the rails 9*a* and 9*b* to the border of the sheet 1*a* at the other end, to produce the configuration shown in a finished film unit in FIG. 3. Next, the individual film units are separated by making cuts in the mask along lines located as indicated by the dotted line 40 in FIG. 2, at a station indicated at 43 in FIG. 1. This operation will produce side flanges 50, located as on either side of the dotted line 40 in FIG. 2, that will then be folded over into the configuration shown in FIG. 3 at a station 44 in FIG. 1, whereafter the film unit is completed by sealing the folded over edges 50 over the ends of the flaps 32 and 37, over the ends of the pods 30, over the ends of the sealing strip 31, and over the ends of the flap 37, and to the insensitive inert edges of the photosensitive sheet 1*a* in the configuration shown in FIG. 3.

Figure 4:
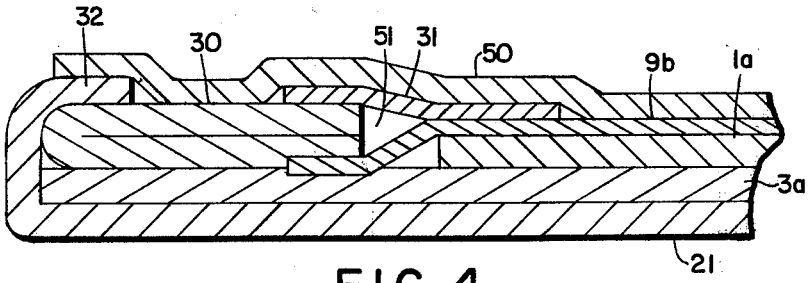
FIG. 4 is a fragmentary diagrammatic elevational sketch, with parts shown in cross-section, and on an enlarged scale, of a portion of the film unit of FIG. 3 as seen essentially along the lines 4—4 in FIG. 3.

Referring to FIG. 4, the general nature of the structural relationships between the parts at the pod end of the completed film unit of FIG. 3 is shown with vertical dimensions greatly exaggerated relative to the horizontal dimensions. In a particular exemplary embodiment, in which the overall dimensions of the film unit of FIG. 3 were approximately 3.5×4.2 in., the thickness of the mask 21 was 1.65 mils, the thickness of the sheet 3*a* was 4.5 mils, the photosensitive sheet was 5.5 mils in thickness, the thickness of the rail 9*b* was 1.5 mils, the width and thickness of the sealing strip 31 were 0.18 inch and 3 mils, respectively, and the thickness of the pod, at the edge 51 where the rupturable seal is located, was about 7 mils. The distance from the left end of the photosensitive sheet 1*a* as seen in FIG. 4 to the left end of the rail 9*b* was approximately 0.25 in. The distance between the end 51 of the pod 30 and the end of the photosensitive sheet 1*a* was 0.065 in. The rails 9*a* and 9*b* were 0.080 in. wide and mask edges 50 overlapping the rail 9*a* and sealed down on the sheet 1*a* were approximately 0.1 in. wide.

Figure 5:
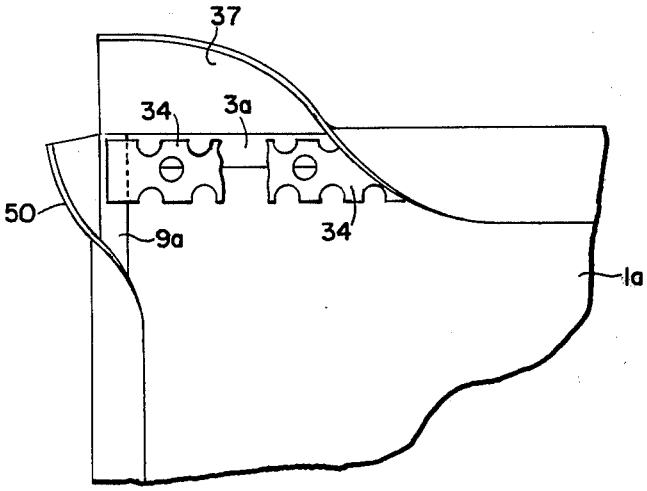
FIG. 5 is a schematic plan view of a portion of the corner of the film unit of FIG. 3 as indicated by the lines 5—5 in FIG. 3, on an enlarged scale, with parts broken, and parts folded, away.

As indicated in FIG. 5, the trap elements 34 lie partly on the sheet 1*a* and partly over the extension of the sheet 3*a* beyond the sheet 1*a*. The ends of the trap elements 34 overlie the ends of the binder rails such as 9*a* so that the thickness of both the binder rail and the trap element contribute to the thickness of the film unit in the trap region at the trailing end of the film unit.

The ends of the portions 50 of the mask 21 that overlap the ends of the portion 37 of the mask form an incomplete seal at the corners of the film unit at the trap region providing vents to allow air to move from one end of the film unit to the other, and thence out of the film unit, during processing of the film. Following exposure, the film unit may be processed by passing the leading edge of the film unit carrying the pod through a pair of rollers, and then continuing to advance the film unit through the rollers until the pod composition is spread uniformly between the sheets 1*a* and 3*a* and the excess is driven into the trap region containing the trap element 34.

Figure 6:
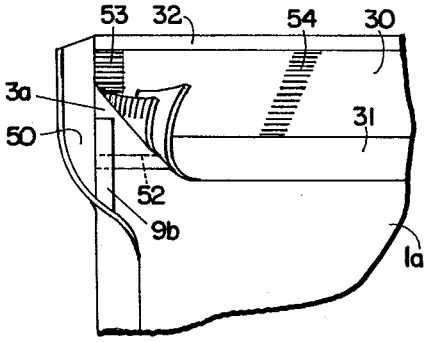
FIG. 6 is a schematic diagrammatic elevational sketch, on an enlarged scale, showing a portion of the pod-end corner of the film unit in FIG. 3 as indicated by the lines 6—6 in FIG. 3, with parts broken away and parts folded back for a clearer view.

Referring now to FIG. 6, the relationships between the parts adjacent the pod end of the film unit is shown in more detail. As shown, the binder rails such as 9*b* extend out over the edge of the photosensitive sheet 1*a* into engagement with the receiving sheet 3*a*, and the binder rails such as 9*b* underlie the sealed end of the pod 30. The dotted line 52 indicates where the edge of the pod 30 through which fluid will emerge is located. The end seals 53 at the ends of the pods 30 extend inboard of the binder rails such as 9*b* so that fluid is initially dispensed in the region between the end of the sheet 1*a* and the pod, which would be located at 52, inside of the rail location and then spread by appropriate design of the film unit, including the location of intermediate pod seals as 54 if desired, in a manner that will be understood by those skilled in the art.

While the invention has been described with respect to the details of specific illustrative embodiments and examples, many changes and variations will occur to those skilled in the art upon reading this description. Such can obviously be made without departing from the scope of the invention.

Having described the invention, what is claimed is:

1. In a process of making photographic products, the steps of superposing first and second elongated sheets of material of different widths with the sheets parallel and the narrower sheet disposed in contact with and intermediate the edges of the wider sheet, one of said sheets having a photosensitive coating thereon on the side facing the other sheet, securing said sheets together at a series of spaced locations by adhering narrow elongated strips of rail material longer than the width of said narrower sheet to said narrower sheet across the width thereof and adhering ends of said strips projecting beyond said narrower strip to the confronting side of said wider sheet in regions beyond said narrower sheet, and, repetitively and sequentially, a plurality of times, severing said joined sheets and one of said strips along a line normal to said sheets to produce an edge along which said sheets are joined by an extended rail element half the width of the severed strip, advancing said edge into contact with a transverse portion of an elongated web of masking material formed with apertures to define image areas and side portions extending beyond the width of said wider sheet, adhering said wider sheet to said transverse portion along said edge, severing said sheets and the next following strip to produce a detached unit connected at said edge to said masking sheet and having a second edge along which detached portions of said narrower and wider sheets are joined by an extended rail element half the width of the strip just severed and producing a new edge on said joined sheets along which said sheets are joined by an extended rail element comprising the other half of the strip just severed, and advancing said masking web a distance greater than the distance between the joined edges of the severed portion of said sheets to bring a new transverse portion of said masking web into the position at which said first recited edge was adhered to said first recited transverse portion.

2. The process of claim 1, in which said coated sheet comprises a support of dimensionally stable material insensitive to light.

3. A photographic film unit, comprising first and second sheets of equal widths and different lengths superimposed with the widths of said sheets in registry and the longer sheet extending beyond the shorter sheet at opposite ends thereof, one of said sheets comprising a dimensionally stable support of inert material coated on the side facing the other sheet with photosensitive material, a pair of spaced rail elements extending lengthwise of said shorter sheet and adhered thereto along opposite edges thereof on the side opposite said longer sheet, said rail elements extending beyond the ends of said shorter sheet into contact with and being adhered to said longer sheet on the side confronting said shorter sheet, a rupturable pod of processing composition supported on said longer sheet at a first end thereof extending beyond said shorter sheet, a fluid trap element supported partly on a second end of said longer sheet opposite said first end and extending onto the contiguous end of said shorter sheet, and a mask adhered to said longer sheet on the side opposite the side confronting said shorter sheet, said mask being formed with an image limiting aperture and being provided with edge portions folded around the edges of said sheets and adhered to the edges of said shorter sheet to confine said pod, rail and trap elements and to form a liquid impermeable seal around the edges of said sheets along which said rail elements are located.

4. A photographic film unit, comprising first and second contiguous rectangular sheets of equal width and different lengths, said first sheet comprising a photochemically inert support coated on one side confronting said second sheet with at least one photosensitive layer, said second sheet having an inert surface on at least one side opposite the side confronting said first sheet, the longer of said sheets having ends extending beyond the ends of said shorter sheet, a pair of narrow elongated binder rail elements having lengths intermediate the lengths of said sheets, means adhering said binder elements to an inert side of said shorter sheet along opposed edges thereof with opposite ends of said binder rail elements extending over onto confronting regions of said longer sheet outside the borders of said shorter sheet, means adhering said extending ends to said longer sheet, a rupturable pod of processing fluid on one end of said longer sheet projecting beyond said shorter sheet, a liquid impermeable masking sheet adhered to said longer sheet on a side opposite the side confronting said shorter sheet, said masking sheet being formed with an image limiting aperture within the borders of said longer sheet and having edge portions extending beyond the edges of said longer sheet, wrapped around and over said pod and said binder rail elements, and then secured to said shorter sheet on a photochemically inert surface thereof to confine said pod and binder rail elements and at least partially enclose a trap region about the other end of said longer sheet projecting from said shorter sheet.

5. In the process of making photographic film units, the steps of binding together first and second elongated sheets of different widths with the narrower sheet disposed between and spaced from the edges of the wider sheet, each sheet having at least one photochemically inert surface on a side away from the other sheet and at least one of said sheets comprising a photochemically inert support coated on the side confronting the other sheet with at least one photosensitive layer, securing said sheets together at locations spaced at fixed distances by placing strips of binder rail material across the sheets at said distances and adhering said strips intermediate their ends to said narrower sheet on a side opposite the wider sheet and at their ends to said wider sheet on the side confronting said narrower sheet, and, repetitively, adhering an edge of one of said sheets at an end of said secured sheets to a web of binder material formed with spaced image limiting apertures smaller than the regions of said narrower sheet between said binder strips along the border of one of said apertures, severing said sheets and one of said binder strips at said distance from said adhered edge, and advancing said binder web by a second distance greater than said first distance while advancing said secured sheets by said first distance to position a new edge on said binder web.

6. A photographic film unit, comprising first and second sheets of equal widths and different lengths superimposed with the widths of said sheets in registry and the longer sheet extending beyond the shorter sheet at opposite ends thereof, one of said sheets comprising a dimensionally stable support of inert material coated on the side facing the other sheet with photosensitive material, a pair of spaced rail elements extending lengthwise of said shorter sheet and adhered thereto along opposite edges thereof on the side opposite said longer sheet, said rail elements extending beyond the ends of said shorter sheet at both ends thereof into contact with and being adhered to said longer sheet on the side confronting said shorter sheet, a rupturable pod of processing composition supported on said longer sheet at a first end thereof extending beyond said shorter sheet, said pod having sealed end portions overlying ends of said elements on said first end of said longer sheet, a fluid trap element supported partly on a second end of said longer sheet opposite said first end and extending onto the contiguous end of said shorter sheet, and a mask adhered to said longer sheet on the side opposite the side confronting said shorter sheet, said mask being formed with an image limiting aperture and being provided with edge portions folded around the edges of said sheets and adhered to the edges of said shorter sheet to confine said pod, rail and trap elements and to form a liquid impermeable seal around the edges of said sheets along which said rail elements are located.

7. A photographic film unit, comprising first and second contiguous rectangular sheets of equal width and different lengths, said first sheet comprising an inert support coated on one side confronting said second sheet with at least one photosensitive layer, said second sheet having a photochemically inert surface on at least one side opposite the side confronting said first sheet, the longer of said sheets having ends extending beyond the ends of said shorter sheet, a pair of narrow elongated binder rail elements having lengths intermediate the lengths of said sheets, means adhering said binder elements to a photochemically inert side of said shorter sheet along opposed edges thereof with opposite ends of said binder rail elements extending over onto confronting regions of said longer sheet outside the borders of said shorter sheet, means adhering said extending ends to said longer sheet, a rupturable pod of processing fluid on one end of said longer sheet projecting beyond said shorter sheet, a liquid impermeable masking sheet adhered to said longer sheet on a side opposite the side confronting said shorter sheet, said masking sheet being formed with an image limiting aperture within the borders of said longer sheet and having edge portions extending beyond the edges of said longer sheet, wrapped around and over said pod and said binder rail elements, and then secured to said shorter sheet on a photochemically inert surface thereof to confine said pod and binder rail elements and at least partially enclose a trap region about the other end of said longer sheet projecting from said shorter sheet, and a trap element within said trap region and having ends overlying the adjacent ends of said rail elements.

8. The process of claim 2, in which said coated sheet is said narrower sheet.

9. The film unit of claim 3, in which said coated sheet is said shorter sheet.

10. The film unit of claim 4, in which said first sheet is said shorter sheet.

11. The process of claim 5, in which said first sheet is said shorter sheet.

12. The film unit of claim 6, in which said shorter sheet is said coated sheet.

13. The film unit of claim 7, in which said first sheet is said shorter sheet.

* * * * *